US012252768B2

(12) United States Patent
Lee et al.

(10) Patent No.: US 12,252,768 B2
(45) Date of Patent: Mar. 18, 2025

(54) STEEL FOR GEAR AND METHOD FOR MANUFACTURING GEAR USING THE SAME

(71) Applicants: Hyundai Motor Company, Seoul (KR); Kia Corporation, Seoul (KR); HYUNDAI STEEL COMPANY, Incheon (KR)

(72) Inventors: In Beom Lee, Goyang-si (KR); Min Woo Kang, Yongin-si (KR); Min Woo Kang, Incheon (KR); Dong Hwi Kim, Yongin-si (KR); Chang Won Kang, Hwaseong-si (KR); Myung Sik Kim, Daegu (KR); Sung Min Hong, Seoul (KR); Gung Seung Nam, Cheonan-si (KR); Sang Won Lee, Asan-si (KR)

(73) Assignees: HYUNDAI MOTOR COMPANY, Seoul (KR); KIA CORPORATION, Seoul (KR); HYUNDAI STEEL COMPANY, Incheon (KR)

( * ) Notice: Subject to any disclaimer, the term of this patent is extended or adjusted under 35 U.S.C. 154(b) by 0 days.

(21) Appl. No.: 18/396,165

(22) Filed: Dec. 26, 2023

(65) Prior Publication Data

US 2024/0124962 A1 Apr. 18, 2024

Related U.S. Application Data

(62) Division of application No. 17/234,428, filed on Apr. 19, 2021, now Pat. No. 11,898,231.

(30) Foreign Application Priority Data

Sep. 21, 2020 (KR) ..... 10-2020-0121558

(51) Int. Cl.
*C22C 38/48* (2006.01)
*C21D 7/13* (2006.01)
(Continued)

(52) U.S. Cl.
CPC ..... *C22C 38/48* (2013.01); *C21D 7/13* (2013.01); *C21D 8/005* (2013.01); *C21D 9/32* (2013.01);
(Continued)

(58) Field of Classification Search
None
See application file for complete search history.

(56) References Cited

U.S. PATENT DOCUMENTS

2010/0139811 A1 6/2010 Kozawa et al.
2012/0263622 A1 10/2012 Daitoh et al.
2019/0352762 A1 11/2019 Ando et al.

FOREIGN PATENT DOCUMENTS

DE 697 18 784 T2 12/2003
JP 2017-020065 A 1/2017
(Continued)

OTHER PUBLICATIONS

English language machine translation of JP-2017020065-A. Generated Jan. 13, 2023. (Year: 2023).
(Continued)

*Primary Examiner* — Brian D Walck
(74) *Attorney, Agent, or Firm* — Morgan, Lewis & Bockius LLP

(57) ABSTRACT

A steel for a gear includes, based on a total weight of the steel: C: 0.10-0.30 wt %, Si: 0.60-0.80 wt %, Mn: 0.25-0.75 wt %, Cr: 1.80-2.20 wt %, Ni: 0.50-1.50 wt %, Mo: 0.20-0.40 wt %, Nb: 0.025-0.050 wt %, V: 0.030-0.050 wt %, and a balance of Fe and inevitable impurities, wherein contents of Nb and V satisfy the following <Relationship Formula 1>:

$$0.055<[Nb]+[V]<0.100 \quad \text{<Relationship Formula 1>,}$$

(Continued)

| | C | Si | Mn | Cr | Ni | Mo | V | Nb | Nb+V |
|---|---|---|---|---|---|---|---|---|---|
| Example 1 | 0.20 | 0.70 | 0.50 | 2.00 | 0.70 | 0.30 | 0.040 | 0.035 | 0.075 |
| Example 2 | 0.20 | 0.70 | 0.50 | 2.00 | 0.70 | 0.30 | 0.030 | 0.035 | 0.060 |
| Example 3 | 0.20 | 0.70 | 0.50 | 2.00 | 0.70 | 0.30 | 0.050 | 0.035 | 0.085 |
| Example 4 | 0.20 | 0.70 | 0.50 | 2.00 | 0.70 | 0.30 | 0.040 | 0.025 | 0.065 |
| Example 5 | 0.20 | 0.70 | 0.50 | 2.00 | 0.70 | 0.30 | 0.040 | 0.050 | 0.090 |
| Example 6 | 0.20 | 0.70 | 0.50 | 2.00 | 0.70 | 0.30 | 0.030 | 0.025 | 0.055 |
| Example 7 | 0.20 | 0.70 | 0.50 | 2.00 | 0.70 | 0.30 | 0.050 | 0.050 | 0.100 |
| Comparative Example 1 | 0.20 | 0.90 | 0.50 | 2.10 | 0.30 | 0.30 | 0.040 | 0.020 | 0.060 |
| Comparative Example 2 | 0.22 | 0.27 | 0.90 | 1.29 | 0.15 | 0.14 | - | 0.025 | 0.025 |
| Comparative Example 3 | 0.18 | 0.11 | 0.70 | 1.32 | 0.10 | 0.60 | - | 0.025 | 0.025 |
| Comparative Example 4 | 0.19 | 0.60 | 0.55 | 2.02 | 0.10 | 0.35 | - | 0.025 | 0.025 |
| Comparative Example 5 | 0.20 | 0.70 | 0.50 | 2.00 | 0.70 | 0.30 | 0.040 | - | 0.040 |
| Comparative Example 6 | 0.20 | 0.70 | 0.50 | 2.00 | 0.70 | 0.30 | - | 0.035 | 0.035 |
| Comparative Example 7 | 0.20 | 0.70 | 0.50 | 2.00 | 0.70 | 0.30 | 0.025 | - | 0.025 |
| Comparative Example 8 | 0.20 | 0.70 | 0.50 | 2.00 | 0.70 | 0.30 | 0.040 | 0.070 | 0.110 |
| Comparative Example 9 | 0.20 | 0.70 | 0.50 | 2.00 | 0.70 | 0.30 | 0.040 | 0.080 | 0.120 |

wherein [Nb] represents a content of Nb and [V] represents a content of V.

3 Claims, 4 Drawing Sheets

(51) Int. Cl.

| | |
|---|---|
| ***C21D 8/00*** | (2006.01) |
| ***C21D 9/32*** | (2006.01) |
| ***C22C 38/02*** | (2006.01) |
| ***C22C 38/04*** | (2006.01) |
| ***C22C 38/44*** | (2006.01) |
| ***C22C 38/46*** | (2006.01) |

(52) U.S. Cl.
CPC ..... *C22C 38/02* (2013.01); *C22C 38/04* (2013.01); *C22C 38/44* (2013.01); *C22C 38/46* (2013.01)

(56) References Cited

FOREIGN PATENT DOCUMENTS

| | | | |
|---|---|---|---|
| KR | 10-2011-0139535 | A | 12/2011 |
| KR | 10-2022-0039011 | A | 3/2022 |

OTHER PUBLICATIONS

English language machine translation of KR-20220039011-A. Generated Jan. 7, 2023. (Year: 2023).
Chaudhury, "Homogenization." ASM Handbook, vol. 15, Casting. pp. 402-403. 2008. (Year: 2008).
Tahira et al. "Forge and Direct Heat Treatment Processes and Technologies." ASM Handbook, vol. 4D, Heat Treating of Irons and Steels. pp. 241-252. 2014. (Year: 2014).
Rowan et al. "Gas Carburizing." ASM Handbook, vol. 4A, Steel Heat Treating Fundamentals and Processes. pp. 528-559. 2013.
Office Action issued on Dec. 20, 2024 in corresponding German patent application 102021111365.2 with English translation.

FIG. 1

| | C | Si | Mn | Cr | Ni | Mo | V | Nb | Nb+V |
|---|---|---|---|---|---|---|---|---|---|
| Example 1 | 0.20 | 0.70 | 0.50 | 2.00 | 0.70 | 0.30 | 0.040 | 0.035 | 0.075 |
| Example 2 | 0.20 | 0.70 | 0.50 | 2.00 | 0.70 | 0.30 | 0.030 | 0.035 | 0.060 |
| Example 3 | 0.20 | 0.70 | 0.50 | 2.00 | 0.70 | 0.30 | 0.050 | 0.035 | 0.085 |
| Example 4 | 0.20 | 0.70 | 0.50 | 2.00 | 0.70 | 0.30 | 0.040 | 0.025 | 0.065 |
| Example 5 | 0.20 | 0.70 | 0.50 | 2.00 | 0.70 | 0.30 | 0.040 | 0.050 | 0.090 |
| Example 6 | 0.20 | 0.70 | 0.50 | 2.00 | 0.70 | 0.30 | 0.030 | 0.025 | 0.055 |
| Example 7 | 0.20 | 0.70 | 0.50 | 2.00 | 0.70 | 0.30 | 0.050 | 0.050 | 0.100 |
| Comparative Example 1 | 0.20 | 0.90 | 0.50 | 2.10 | 0.30 | 0.30 | 0.040 | 0.020 | 0.060 |
| Comparative Example 2 | 0.22 | 0.27 | 0.90 | 1.29 | 0.15 | 0.14 | - | 0.025 | 0.025 |
| Comparative Example 3 | 0.18 | 0.11 | 0.70 | 1.32 | 0.10 | 0.60 | - | 0.025 | 0.025 |
| Comparative Example 4 | 0.19 | 0.60 | 0.55 | 2.02 | 0.10 | 0.35 | - | 0.025 | 0.025 |
| Comparative Example 5 | 0.20 | 0.70 | 0.50 | 2.00 | 0.70 | 0.30 | 0.040 | - | 0.040 |
| Comparative Example 6 | 0.20 | 0.70 | 0.50 | 2.00 | 0.70 | 0.30 | - | 0.035 | 0.035 |
| Comparative Example 7 | 0.20 | 0.70 | 0.50 | 2.00 | 0.70 | 0.30 | 0.025 | - | 0.025 |
| Comparative Example 8 | 0.20 | 0.70 | 0.50 | 2.00 | 0.70 | 0.30 | 0.040 | 0.070 | 0.110 |
| Comparative Example 9 | 0.20 | 0.70 | 0.50 | 2.00 | 0.70 | 0.30 | 0.040 | 0.080 | 0.120 |

FIG. 2

| | MX precipitate fraction (%) | Count of MX precipitate (/100μm$^2$) | Gear pitting area (mm$^2$) | Tooth bending fatigue life (cycles) |
|---|---|---|---|---|
| Example 1 | 0.042 | 130 | 7.4 | 7,575 |
| Example 2 | 0.034 | 50 | 10.1 | 4,328 |
| Example 3 | 0.052 | 424 | 5.9 | 7,980 |
| Example 4 | 0.044 | 165 | 6.9 | 7,703 |
| Example 5 | 0.041 | 116 | 7.7 | 7,197 |
| Example 6 | 0.035 | 57 | 9.8 | 4,723 |
| Example 7 | 0.05 | 335 | 6 | 7,916 |
| Comparative Example 1 | 0.027 | 22 | 12.2 | 3,009 |
| Comparative Example 2 | 0.023 | 14 | 16.3 | 1,685 |
| Comparative Example 3 | 0.026 | 20 | 15.5 | 1,801 |
| Comparative Example 4 | 0.024 | 15 | 14.2 | 1,997 |
| Comparative Example 5 | 0.007 | 2 | 11.6 | 3,492 |
| Comparative Example 6 | 0.025 | 17 | 11 | 3,710 |
| Comparative Example 7 | 0 | 0 | 12.3 | 2,876 |
| Comparative Example 8 | 0.039 | 91 | 8.5 | 3,291 |
| Comparative Example 9 | 0.038 | 81 | 9.1 | 3,116 |

STEEL FOR GEAR AND METHOD FOR MANUFACTURING GEAR USING THE SAME

CROSS REFERENCE TO RELATED APPLICATION

This application is the divisional application of U.S. patent application Ser. No. 17/234,428 filed on Apr. 19, 2021, which claims priority to Korean Patent Application No. 10-2020-0121558, filed Sep. 21, 2020 in the Korean Intellectual Property Office, the entire contents of which is incorporated herein for all purposes by this reference.

TECHNICAL FIELD

The present disclosure relates to steel for a gear and a method for manufacturing the gear using the same, and more particularly, to steel for a gear, which has improved fatigue resistance and a method for manufacturing the same.

BACKGROUND

In an automobile, steel with various physical properties is employed for automobile parts.

Among automobile parts, gears are parts requiring fatigue resistance and are generally manufactured of carburized steels. Particularly, studies on carburized steel for use in gears has been targeted at a strength increase by inducing carbide formation and enhanced tempering resistance through an alloy design of increasing contents of Cr and Si elements, with the aim of improving fatigue resistance.

However, there is a limitation in that alloys with high contents of Cr and Si elements can be subjected to carburizing heat treatment only in a carburizing heat treatment facility where a vacuum atmosphere is maintained. Therefore, a carburizing heat treatment facility in an air atmosphere cannot be applied to the carburizing heat treatment of alloys having high contents of Cr and Si elements.

In addition, carburized parts such as gears are generally manufactured only after significantly many processes including rolling, rolling heat treatment, forging, ISO heat treatment, carburizing heat treatment, and short pinning.

Hence, studies have been conducted into techniques of simplifying part manufacturing processes in order to achieve cost saving and productivity improvement.

The description given in the related art is only to understand the background of the present disclosure, but should not be recognized as a prior art already known to a person skilled in the art.

SUMMARY

The present disclosure provides a steel for a gear, which can be subjected to carburizing heat treatment in an air atmosphere and has improved fatigue resistance, compared to conventional steel, and a gear manufacturing method using the same.

Steel for a gear according to an embodiment of the present disclosure comprises, based on a total weight of the steel: C: 0.10-0.30 wt %, Si: 0.60-0.80 wt %, Mn: 0.25-0.75 wt %, Cr: 1.80-2.20 wt %, Ni: 0.50-1.50 wt %, Mo: 0.20-0.40 wt %, Nb: 0.025-0.050 wt %, V: 0.030-0.050 wt %, and a balance of Fe and inevitable impurities, satisfying the following <Relationship Formula 1>:

$$0.055<[Nb]+[V]<0.100 \quad \text{<Relationship Formula 1>},$$

wherein [Nb] represents a content of Nb and [V] represents a content of V.

The steel may further comprise P: 0.020 wt % or less and S: 0.020 wt % or less.

The steel may have a metallic carbide or metallic nitride (MX) precipitate formed at a fraction of 0.03-0.07% therein.

The MX precipitate may be at least one of a Nb-based carbide, a Nb-based nitride, a V-based carbide, a V-based nitride, a Nb+V-based carbide, or a Nb+V-based nitride.

The MX precipitate may be 150 nm or less in size.

The MX precipitate may be formed at a density of 50 or more precipitates per 100 $\mu m^2$.

A method for manufacturing a gear in accordance with an embodiment of the present disclosure may comprise:

a molten metal preparing step of preparing a molten metal comprising C: 0.10-0.30 wt %, Si: 0.60-0.80 wt %, Mn: 0.25-0.75 wt %, Cr: 1.80-2.20 wt %, Ni: 0.50-1.50 wt %, Mo: 0.20-0.40 wt %, Nb: 0.025-0.050 wt %, V: 0.030-0.050 wt %, and the balance of Fe and inevitable impurities, wherein contents of Nb and V satisfy the following <Relationship Formula 1>:

$$0.055<[Nb]+[V]<0.100 \quad \text{<Relationship Formula 1>}$$

wherein, [Nb] represents a content of Nb and [V] represents a content of V;

a pre-rolling heat treatment step of casting molten metal and then thermally treating the cast molten metal;

a rolled steel rolling step of rolling the thermally treated cast steel into a rolled steel;

a forged steel forging step of forging the thermally treated, rolled steel into a planetary gear;

a forged steel heat treatment step of thermally treating the forged steel;

an article processing step of processing the forged steel into a final article; and a carburizing heat treatment step of carburizing the final article.

The heat treatment temperature in the pre-rolling heat treatment step may be maintained at or below the liquidus curve of the cast steel.

The heat treatment temperature in the pre-rolling heat treatment step may be 1180-1430° C.

The forged steel heat treatment step may be carried out in an ISO heat treatment condition.

The carburizing heat treatment step may be carried out in the following conditions: heat treatment temperature: 850-940° C., carbon potential (C.P): 0.7-1.0, and heat treatment duration: 100 minutes.

The final article after the carburizing heat treatment step may have a pitting area of less than 12 $mm^2$ as measured by a fatigue test (SAE J 1619).

The final article after the carburizing heat treatment step may exhibit 4,000 cycles of tooth bending fatigue testing.

The final article after the carburizing heat treatment step may have a MX precipitate formed at a fraction of 0.03-0.07% therein, the MX precipitate being 150 nm or less in size and amounting to 50 or more per 100 $\mu m^2$.

The MX precipitate may be at least one of a Nb-based carbide, a Nb-based nitride, a V-based carbide, a V-based nitride, a Nb+V-based carbide, and a Nb+V-based nitride.

BRIEF DESCRIPTION OF THE DRAWINGS

The above and other aspects, features and advantages of the present disclosure will be more apparent from the following detailed description taken in conjunction with the accompanying drawings, in which:

FIG. 1 is a table in which components used in Examples and Comparative Examples are listed, FIG. 2 is a table showing precipitate states and physical properties in Examples and Comparative Examples.

DETAILED DESCRIPTION

Figure 3:
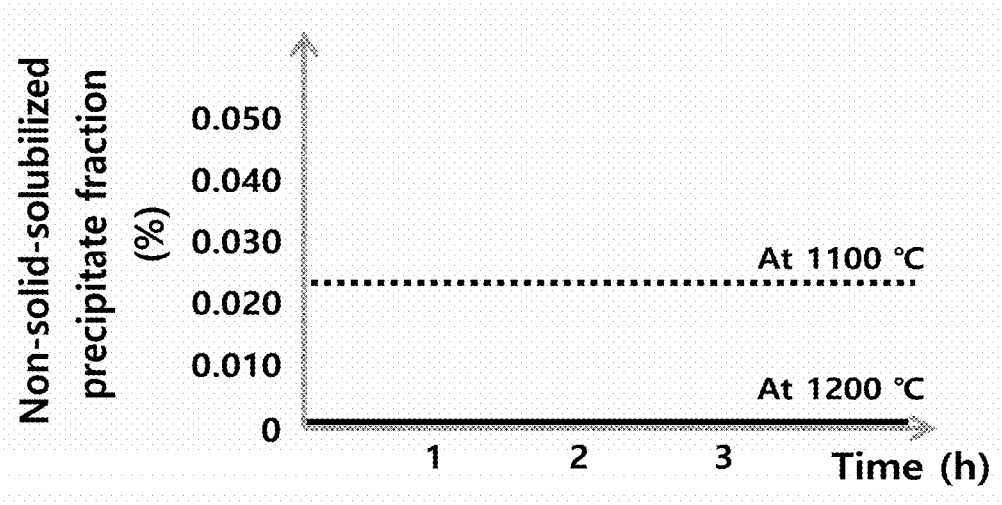
FIG. 3 is a graph showing fractions of non-solid-solubilized precipitates produced according to pre-rolling heat treatment temperatures in a pre-rolling heat treatment step.

Hereinafter, embodiments of the present disclosure will be described in detail in conjunction with the accompanying drawings. However, the present disclosure is not limited to embodiments that will be disclosed below, and but may be implemented in various different forms. These embodiments are merely provided to make the disclosure of the present disclosure complete and to make those having ordinary knowledge in the art to which the present disclosure pertains completely understand the scope of the present disclosure.

Steel for a gear according to an embodiment of the present disclosure, which can be used for manufacturing gears among automobile parts, has fine precipitates which are controlled in terms of fraction, number, and size with the content optimization of main alloy components.

Specifically, the steel for a gear according to an embodiment of the present disclosure comprises: C: 0.10-0.30 wt %, Si: 0.60-0.80 wt %, Mn: 0.25-0.75 wt %, Ni: 0.50-1.50 wt %, Cr: 1.80-2.20 wt %, Mo: 0.20-0.40 wt %, Nb: 0.025-0.050 wt %, V: 0.030-0.050 wt %, and the balance of Fe and inevitable impurities. The steel may further comprise P: 0.020 wt % or less and S: 0.020 wt % or less.

Having influence on the production of fine precipitates, contents of Nb and V according to the embodiment preferably meet the following <Relationship Formula 1>:

$$0.055<[Nb]+[V]<0.100 \quad \text{<Relationship Formula 1>}$$

wherein [Nb] represents a content of Nb and [V] represents a content of V.

In the present disclosure, the reason why the alloy components and the amounts thereof are limited is as follows. Unless otherwise stated, "%" and "fraction", when each represent the unit of the amount of the component, refer to "wt %" and "fraction", respectively.

Carbon (C) is preferably contained in an amount of 0.10-0.30%.

Carbon (C) is an element which is responsible for the formation of a metallic carbide or metallic nitride (MX) precipitate and forms a solid solution in a matrix to increase the strength of the steel. The steel requires carbon (C) at a content of 10% or more for sufficiently increasing the strength thereof. However, when the content of carbon (C) exceeds 0.30%, the toughness remarkably decreases. Therefore, the content of carbon (C) is preferably limited to 0.10-0.30%.

Silicon (Si) is preferably contained in an amount of 0.60-0.80%.

Silicon (Si) is an element that increases temper softening resistance in carburized steel. The steel requires silicon (Si) at a content of 0.60% or more for increasing the durability thereof. However, when the content of silicon (Si) exceeds 0.80%, an oxide is formed on the surface portion of the steel carburized in an air atmosphere, thus interfering with the diffusion of carbon. Therefore, the content of silicon (Si) is preferably limited to 0.60-0.80% in order to secure durability in the steel and to prevent the formation of oxides on the surface of the steel upon carburizing an air atmosphere.

Manganese (Mn) is preferably contained in an amount of 0.25-0.75%.

Manganese (Mn) is an element that is useful for deoxidizing steel and forms a solid solution in a matrix to enhance hardenability. The steel requires manganese (Mn) at a content of 0.25% or more for enhancing the bending fatigue strength thereof. However, when the content of manganese (Mn) exceeds 0.75%, the matrix increases in hardness, which leads to a remarkable decrease in processability. Therefore, the content of manganese (Mn) is preferably limited to 0.25-0.75% in order to prevent the steel from decreasing in bending fatigue strength and processability.

Nickel (Ni) is preferably contained in an amount of 0.50-1.50%.

Nickel (Ni) is an element that enhances hardenability and toughness in steel. The steel requires nickel (Ni) at a content of 0.50% or more for increasing the fatigue resistance thereof. However, nickel (Ni) is an expensive element. Therefore, the content of nickel (Ni) is preferably limited to 0.50-1.50% in order to reduce the production cost.

Chromium (Cr) is preferably contained in an amount of 1.80-2.20%.

Chromium (Cr) is an element that increases the strength and hardenability of the steel. The steel requires chromium (Cr) at a content of 1.80% or more for enhancing the durability thereof. However, when the content of chromium (Cr) exceeds 2.20%, oxides and carbides are formed on the surface of the steel upon carburizing heat treatment in an air atmosphere to interfere with the diffusion of carbon. Therefore, the content of chromium (Cr) is preferably limited to 1.80-2.20% in order to secure the durability of the steel and to prevent the formation of oxides on the steel upon carburizing heat treatment in an air atmosphere.

Molybdenum (Mo) is preferably contained in an amount of 0.20-0.40%.

Molybdenum (Mo) is an element that enhances hardenability. The steel requires molybdenum (Mo) at a content of 0.20% or more for increasing the hardness thereof after carburizing heat treatment. However, when the content of molybdenum (Mo) exceeds 0.40%, only a slight increasing effect is obtained with respect to hardness and is thus not effective in view of cost. Therefore, the content of molybdenum (Mo) is preferably limited to 0.20-0.40%.

Niobium (Nb) is preferably contained in an amount of 0.025-0.050%.

Niobium (Nb) is an element that forms a composite MX precipitate during carburizing heat treatment. A MX precipitate is a factor that inhibits precipitation strengthening and grain coarsening in steel. The steel requires niobium (Nb) at a content of 0.025% or more for forming a proper MX precipitate. However, an increase in the content of niobium (Nb) leads to an increase in solid solution temperature, and the Nb element that does not form a solid solution forms a coarse MX precipitate during the heat treatment of rolled steel. The coarse MX precipitate thus formed is unable to effectively interfere with potential migration and thus contributes little to a fatigue life. Therefore, the content of niobium (Nb) is preferably limited to 0.025-0.050% such that niobium (Nb) forms a maximum solid solution during the heat treatment of rolled steel to increase the formation of a fine MX precipitate.

Vanadium (V) is preferably contained in an amount of 0.030-0.050%.

Vanadium (V) is an element that forms a composite MX precipitate during carburizing heat treatment, like niobium (Nb). The steel requires vanadium (V) at a content of 0.030% or more for enhancing the precipitation strengthening thereof. However, when the content of vanadium (V) exceeds 0.050%, only a slight increasing effect is obtained with respect to precipitation strengthening and is thus not effective in view of cost. Therefore, the content of vanadium (V) is preferably limited to 0.030-0.050%.

Phosphorus (P) and sulfur (S) are inevitable impurities in steel and the contents thereof are preferably limited to be as low as possible. In light of the process of removing phosphorus (P) and sulfur (S), the contents of phosphorus (P) and sulfur (S) are each preferably limited to 0.020 wt %.

Remaining components other than the above-mentioned components include iron (Fe) and inevitably contained impurities.

In addition, the total content of niobium (Nb) and vanadium (V), which are elements responsible for the formation of a composite MX precipitate in the embodiment of the present disclosure, meets the following <Relationship Formula 1>:

$$0.055<[Nb]+[V]<0.100 \qquad \text{<Relationship Formula 1>}$$

wherein [Nb] represents a content of Nb and [V] represents a content of V.

When being lower than the lower limit of the range, the total content of niobium (Nb) and vanadium (V), which are responsible for the formation of a MX precipitate, allows the formation of a fine MX precipitate at an undesired level and thus cannot be expected to improve physical properties such as strength and fatigue resistance. On the other hand, when the total content of niobium (Nb) and vanadium (V) is greater than the upper limit of the range, the steel increases in solid solution temperature, so that the niobium (Nb) and vanadium (V) that are not involved in the solid solution cause the formation of a coarse MX precipitate during heat treatment of the rolled steel. The coarse MX precipitate thus formed is unable to effectively interfere with potential migration and thus reduces the effect of enhancing the fatigue life of the steel.

The MX precipitate described above is formed by niobium (Nb) and vanadium (V) and is at least one of a Nb-based carbide, a Nb-based nitride, a V-based carbide, a V-based nitride, a Nb+V-based carbide, or a Nb+V-based nitride.

When meeting the condition, the steel for a gear according to an embodiment of the present disclosure has a MX precipitate formed at a fraction of 0.03-0.07% therein.

In this regard, the MX precipitate is 150 nm or less in size and is formed at a density of 50 or more precipitates per 100 $\mu m^2$.

Below, a description will be given of a method for manufacturing a gear using the steel for a gear which is prepared through the aforementioned alloy design.

A method for manufacturing a gear according to an embodiment of the present disclosure comprises: a molten metal preparing step; a pre-rolling heat treatment step of casting molten metal and then thermally treating the cast molten metal; a rolled steel rolling step of rolling the thermally treated cast steel into a rolled steel; a forged steel forging step of forging the thermally treated, rolled steel into a planetary gear; a forged steel heat treatment step of thermally treating the forged steel; an article processing step of processing the forged steel into a final article; and a carburizing heat treatment step of carburizing the final article.

The molten metal preparing step is to prepare a molten metal according to the aforementioned alloy design for the steel for a gear, in which a molten metal comprising C: 0.10-0.30 wt %, Si: 0.60-0.80 wt %, Mn: 0.25-0.75 wt %, Cr: 1.80-2.20 wt %, Ni: 0.50-1.50 wt %, Mo: 0.20-0.40 wt %, Nb: 0.025-0.050 wt %, V: 0.030-0.050 wt %, and the balance of Fe and inevitable impurities as described above. In this regard, the total content of Nb and V meets <Relationship Formula 1>.

In the pre-rolling heat treatment step, a cast steel obtained using a typical continuous casting method is thermally treated so that Nb and V, which are elements responsible for the improvement of moldability and the formation of MX precipitates, are involved in the formation of a solid solution to the maximal extent.

In this regard, the heat treatment temperature at which the cast steel is thermally treated before rolling may be maintained at or below the liquidus curve of the cast steel. For example, the heat treatment temperature may be maintained at 1180-1430° C. When the heat treatment temperature is below the lower limit of the range, Nb and V do not form a solid solution in the rolled steel, which results in forming a coarse MX precipitate before rolling and during carburization. The coarse MX precipitate thus formed reduces a fatigue life.

In the rolled steel rolling step, the thermally treated cast steel is rolled using a typical rolling method.

In the forged steel forging step, the rolled steel is forged into a gear form using a typical forging method.

The forged steel heat treatment step is conducted in order to enhance processability and to minimize deformation upon the subsequent heat treatment.

To this end, the forged steel heat treatment step is carried out in an ISO heat treatment condition.

Here, the ISO heat treatment is to improve a band structure and suppress the precipitation of a bainite structure upon maintenance at less than Ac1 temperature after austenitizing.

In the article processing step, the thermally treated, forged steel is processed into a gear, which is the final article.

The processing is carried out as a post processing such as typical rough machining or fine machining.

In the carburizing heat treatment step, the processed gear is heated in a carburizing atmosphere to diffuse and infiltrate carbon (C) onto the surface of the gear, followed by quenching so as to improve physical properties of the gear. In this context, among elements forming a solid solution in the forged steel, Nb and V, which are precipitate forming elements, produce a MX precipitate.

In order to attain a desired level of MX precipitates, the carburizing heat treatment step is preferably carried out in the following condition: heat treatment temperature: 850-940° C., carbon potential (C.P): 0.7-1.0, and heat treatment duration: 100 minutes.

Hereinafter, the present disclosure is described with reference to Examples and Comparative Examples.

According to production conditions for commercially produced gears, experiments were performed to produce final products. As shown in FIG. 1, gear samples were manufactured according to the aforementioned gear manufacturing method using the molten metals that were produced while varying contents of individual components as seen in FIG. 1.

The rolled steel was thermally heated at 1200° C. for 3 hours while the forged steel was carburized at 920° C. for 200 minutes. In this regard, the carbon potential (C.P) was maintained at 0.8.

The gears thus manufactured according to the Examples and the Comparative Examples were measured for fraction rates and numbers of MX precipitates and for pitting area and tooth bending fatigue life. The results are summarized in FIG. 2.

To measure pitting resistance of gears, a gear durability test rig for a powertrain was employed. In practice, sun gear parts were manufactured and tested. As a criterion for gear pitting, vibration was sensed and measured. The test conditions are as follows:

RPM: 3200 (rpm)
Torque: 180 (Nm)
Flow rate: 1 (L/min)
Oil Temp.: 80(° C.)
Time: 16.67 (hr)

In order to measure tooth bending fatigue lives, spur gear specimens with module 4.23 were manufactured and measured using a repeated tension and compression tester, and test conditions are as follows:

Test standard: SAE J 1619
Test frequency: 10 Hz
Load condition: R=0.1 (R=minimum load/maximum load=0.1)

As is understood from the data of FIGS. 1 and 2, the embodiments according to the present disclosure meet all the requirements of the present disclosure, including the fraction and number of MX precipitates, and the pitting areas and tooth bending fatigue lives of gears.

For example, in Examples 1 to 7 according to the present disclosure, MX precipitates 150 nm or less in size were formed at a fraction of 0.03-0.07% and at a density of 50 precipitates per 100 $\mu m^2$. Thus, the gears were observed to have a pitting area of less than 12 $mm^2$ as measured by a fatigue test and to undergo 4,000 cycles of tooth bending fatigue testing (SAE J 1619).

Particularly, Comparative Examples 1 to 4 in which at least one alloy element of Si, Cr, Ni, and Mo does not meet the content range proposed in the present disclosure exhibited results in which fractions and numbers of MX precipitates and gear pitting areas all did not meet the standards of the present disclosure.

Comparative Examples 5 to 7, although falling within the respective content conditions of C, Si, Mn, Cr, Ni, and Mo, are not satisfactory for the proposed content range of at least one of Nb and V. In these Comparative Examples, fractions and numbers of MX precipitates fell short of the requirements of the present disclosure. Particularly, Comparative Example 7 does not meet the criterion of the present disclosure even in terms of gear pitting area.

Next, in order to examine production fractions of non-solid-solubilized precipitates according to pre-rolling heat treatment temperatures, the cast steel formed of the composition of Example 1 in FIG. 1 was thermally treated at 1100° C. and 1200° C., separately, in the pre-rolling heat treatment step. The fractions of the non-solid-solubilized precipitates were measured and are shown in FIG. 3.

As can be seen in FIG. 3, when the heat treatment was carried out at 1100° C., which is lower than the lower limit of the range proposed in the present disclosure, non-solid-solubilized precipitates were produced at a fraction of about 0.025%.

In contrast, when the heat treatment was carried out at 1200° C., which falls within the range proposed in the present disclosure, no non-solid-solubilized precipitates were formed.

Based on the results, the pre-rolling heat treatment temperature was changed as given in Table 1. In subsequent processes, gears were manufactured according to the manufacturing method proposed in the present disclosure, and the production fractions of fine MX precipitates were measured and are given in Table 1.

In the carburizing heat treatment step, the carburizing heat treatment condition was maintained at 920° C. for 200 minutes, with the carbon potential (C.P) maintained at 0.8.

TABLE 1

| | Pre-Rolling Heat Treatment Temp. (° C.) | Fine MX Precipitate Fraction (%) |
|---|---|---|
| Comparative Example 1-1 | 1100 | 0.018 |
| Comparative Example 1-2 | 1150 | 0.028 |
| Example 1-1 | 1180 | 0.036 |
| Example 1-2 | 1200 | 0.042 |

As seen in Table 1, in Comparative Examples 1-1 and 1-2 in which the pre-rolling heat treatment temperatures were lower than the lower limit of the range proposed in the present disclosure, fractions of fine MX precipitates were less than 0.030%.

In contrast, Examples 1-1 and 1-3 that set pre-rolling heat treatment temperatures satisfying the range proposed in the present disclosure produced fine MX precipitates at a fraction of more than 0.030%.

In order to examine production fractions of non-solid-solubilized precipitates according to heat treatment temperatures in the carburizing heat treatment step, the articles formed of the composition of Example 1 in FIG. 1 were thermally treated at 850° C. and 920° C., separately. The fractions of fine MX precipitates were measured and are shown in FIG. 4.

Figure 4:
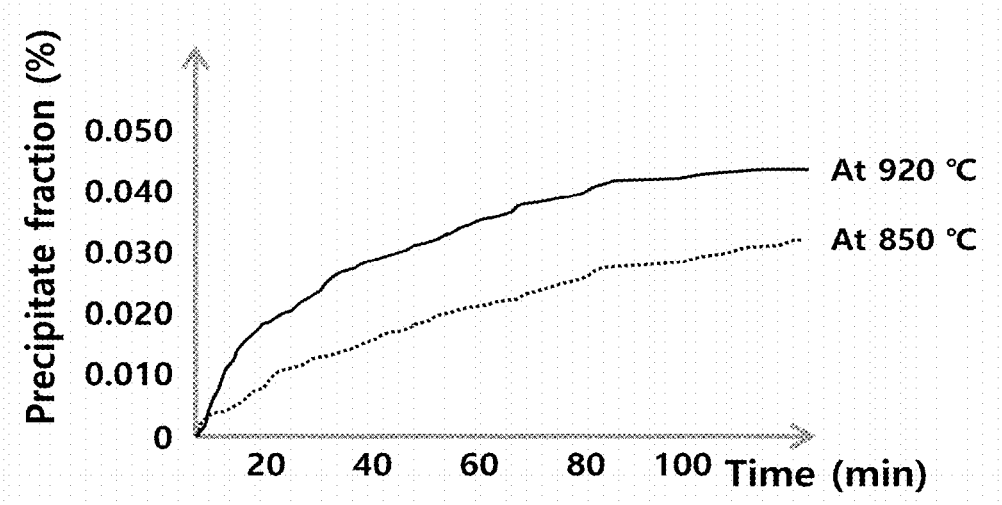
FIG. 4 is a graph showing fractions of fine MX precipitates according to heat treatment temperatures for articles in a carburizing heat treatment step.

As can be seen in FIG. 4, the articles increased in MX precipitate fraction with carburizing time. In particular, when carburizing heat treatment was carried out at 850° C., the fraction of fine MX precipitates exceeded 0.030% after 100 minutes of carburization.

At a carburizing heat treatment temperature of 900° C., the fraction of fine MX precipitates was observed to increase over 0.030% after about 50 minutes of the heat treatment.

Therefore, carburizing heat treatment should be performed at 850° C. or higher for 100 minutes or longer in order to maintain the fraction of fine MX precipitates at 0.030% or more.

Based on the results, the carburizing heat treatment of the article was changed as given in Table 2, below. The fractions of fine MX precipitates thus formed were measured and are summarized in Table 2, too.

The heat treatment condition was maintained at 1200° C. for 3 hours in the pre-rolling heat treatment step and then changed to the carburizing heat treatment condition and maintained for 200 minutes in the carburizing heat treatment step, with the carbon potential (C.P) being maintained at 0.8.

TABLE 2

| | Carburizing Heat Treatment Temp. (° C.) | Fine MX Precipitate Fraction (%) |
|---|---|---|
| Comparative Example 2-1 | 830 | 0.023 |
| Comparative Example 2-2 | 840 | 0.028 |
| Example 2-1 | 850 | 0.032 |
| Example 2-2 | 900 | 0.042 |
| Example 2-3 | 920 | 0.042 |
| Example 2-4 | 940 | 0.038 |
| Comparative Example 2-3 | 1000 | 0.029 |

As seen in Table 2, in Comparative Examples 2-1 and 2-2 in which the carburizing heat treatment temperatures were lower than the lower limit of the range proposed in the present disclosure, fractions of fine MX precipitates were less than 0.030%.

In Comparative Example 2-3 in which the carburizing heat treatment temperature was higher than the upper limit of the range proposed in the present disclosure, the fraction of fine MX precipitates was less than 0.030%, too.

In contrast, Examples 2-1 and 2-3 that set carburizing heat treatment temperatures satisfying the range proposed in the present disclosure produced fine MX precipitates at a fraction of more than 0.030%.

Figure 5A:
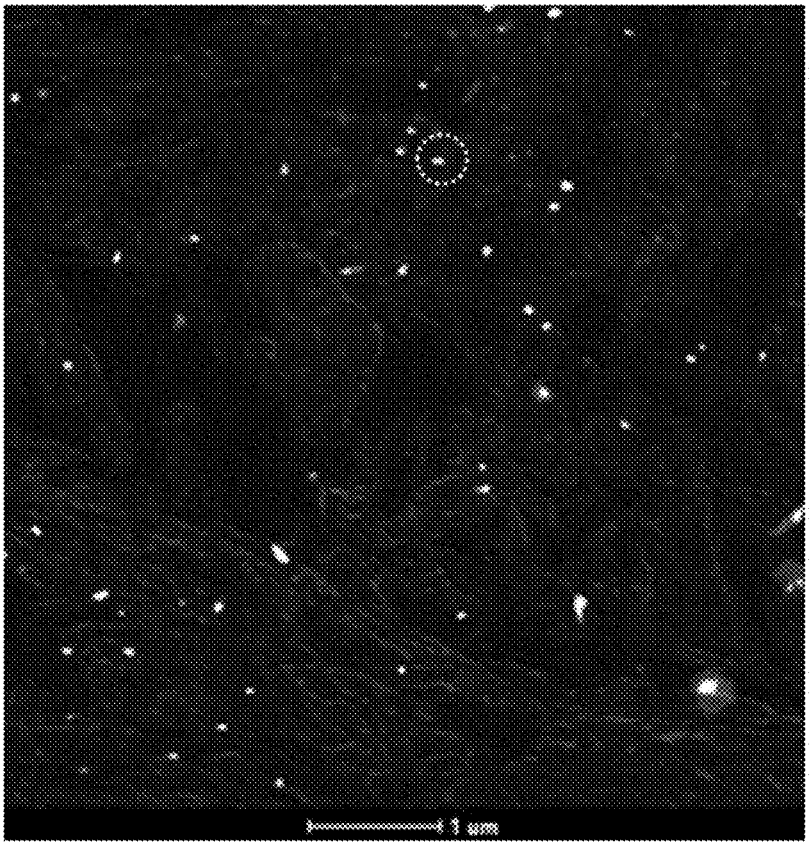
FIGS. 5A and 5B are views showing MX precipitates and components thereof, respectively, on a gear sample manufactured according to Example 1, as analyzed by EDS (Energy-dispersive x-ray spectroscopy).
Figure 5B:
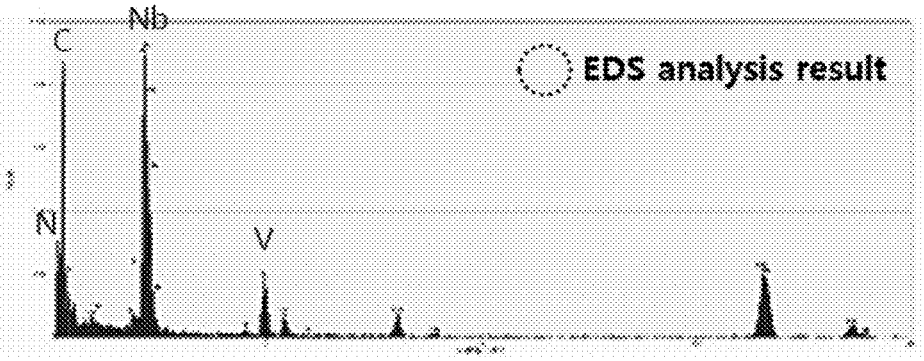

Afterwards, components of the MX precipitates formed in the gear samples manufactured according to Example 1 were subjected to EDS analysis and the results are shown in FIGS. 5A and 5B. Numbers and sizes of the MX precipitates formed on gear samples were measured.

As shown in FIGS. 5A and 5B, Nb, V, C, and N were detected in the MX precipitates, indicating that the MX precipitates are formed of at least one of Nb-based carbides, Nb-based nitrides, V-based carbides, V-based nitrides, Nb+V-based carbides, and Nb+V-based nitrides.

In this regard, the MX precipitates were measured to have an average size of 51 nm and amount to 130 per 100 $m^2$.

As described hitherto, the steel according to embodiments of the present disclosure can be subjected to carburizing heat treatment even in an air atmosphere, with contents of Cr and Si kept similar to those in conventional steel.

The steel contains NI at an increased content, compared to conventional steel, thus exhibiting improved toughness and fatigue resistance.

In consideration of the rolling process temperature, the steel has an increased total content of Nb and V, compared to conventional steel, so as to produce fine precipitates, whereby an increased fraction of MX precipitates produced after carburizing heat treatment is obtained, contributing to an improvement in fatigue resistance.

Moreover, an improvement is brought in physical properties with the content adjustment of main alloy components, which may lead to eliminating a post process such as a CSP (Conventional Shot Peening) process.

It will be appreciated by those having ordinary knowledge in the art to which the present disclosure pertains that the present disclosure may be practiced in other specific forms without changing the technical spirit and essential features of the present disclosure. Therefore, it should be understood that the above-described embodiments are illustrative but not restrictive in all aspects. The scope of the present disclosure is defined by the scope of the attached claims, rather than the detailed description. It should be appreciated that all variations and modifications derived from the scope of the claims and the equivalent concepts thereof are included in the scope of the present disclosure.

What is claimed is:

1. Steel for a gear, consisting of, based on a total weight of the steel:

C: 0.10-0.30 wt %;
Si: 0.60-0.80 wt %;
Mn: 0.25-0.75 wt %;
Cr: 1.80-2.20 wt %;
Ni: 0.50-1.50 wt %;
Mo: 0.20-0.40 wt %;
Nb: 0.025-0.050 wt %;
V: 0.030-0.050 wt %; and
a balance of Fe and inevitable impurities,
wherein contents of Nb and V satisfy the following <Relationship Formula 1>:

$$0.055<[Nb]+[V]<0.100 \quad \text{<Relationship Formula 1>,}$$

wherein [Nb] represents a content of Nb and [V] represents a content of V,
wherein the steel has a metallic carbide or metallic nitride (MX) precipitate formed at a fraction of 0.03-0.07% therein,
wherein the MX precipitate is 150 nm or less in size, and
wherein the MX precipitate is formed at a density of 50 or more precipitates per 100 $\mu m^2$.

2. The steel of claim 1, further comprising, based on a total wight of the steel:

P: 0.020 wt °/o or less; and
S: 0.020 wt °/o or less.

3. The steel of claim 1, wherein the MX precipitate is at least one of a Nb-based carbide, a Nb-based nitride, a V-based carbide, a V-based nitride, a Nb+V-based carbide, or a Nb+V-based nitride.

* * * * *